US005855127A

United States Patent [19]

Kohara et al.

[11] Patent Number: 5,855,127

[45] Date of Patent: Jan. 5, 1999

[54] BALANCER FOR DEHYDRATION TUB FOR USE IN WASHING MACHINE OR THE LIKE

[75] Inventors: Hisayoshi Kohara, Nagoya; Hiroshi Nishimura, Seto; Yuuji Takai, Gifu, all of Japan

[73] Assignee: Kabushiki Kaisha Toshiba, Kawasaki, Japan

[21] Appl. No.: 816,176

[22] Filed: Mar. 12, 1997

[30] Foreign Application Priority Data

Mar. 12, 1996 [JP] Japan ..... 8-054651

[51] Int. Cl.[6] ..... D06F 37/24

[52] U.S. Cl. ..... 68/23.2; 74/573 F

[58] Field of Search ..... 68/23.2; 74/573 F; 210/144, 363

[56] References Cited

U.S. PATENT DOCUMENTS 2,525,781 10/1950 De Remer ..... 74/573 F X 5,197,352 3/1993 Haikawa ..... 74/573 F X

FOREIGN PATENT DOCUMENTS 299297 6/1986 Japan ..... 68/23.2

*Primary Examiner*—Philip R. Coe

*Attorney, Agent, or Firm*—Pillsbury Madison & Sutro LLP

[57] ABSTRACT

A balancer mounted on an upper portion of a dehydration tub of a washing machine includes a balancer container formed into an annular configuration and having an upper opening, at least one partition wall standing from a bottom of the container so as to divide the interior of the container into at least two concentric compartments, a predetermined amount of liquid contained in each compartment of the container, a lid mounted on an upper portion of the container so as to close upper openings of the compartments, an air passage formed in a boundary between the partition wall and the lid so as to extend along a circumference of the container, and at least one hole formed in the lid to communicate with the air passage.

12 Claims, 20 Drawing Sheets

BALANCER FOR DEHYDRATION TUB FOR USE IN WASHING MACHINE OR THE LIKE

BACKGROUND OF THE INVENTION

1. Field of the Invention

This invention relates generally to a balancer for dehydration tubs for use in washing machines or the like, and more particularly to such a balancer of the liquid-in-container type including a concentric multi-compartment container.

2. Description of the Prior Art

In dehydration tubs used in washing machines having a centrifugal dehydrating function or the like, a liquid-in-container type balancer is mounted on an upper open end of the dehydration tub for the purpose of correcting an unbalanced condition thereof due to one-sided laundry. For improvement in a correcting force, the interior of the balancer is divided by one or more vertically extending concentric partition walls into a plurality of compartments. A predetermined amount of liquid (usually, salt water) is contained in each of the compartments.

FIGS. 23 and 24 illustrate the construction of a conventional balancer of the type described above. Referring to FIG. 24, the balancer comprises an annular balancer container 1 having in its interior a partition wall 2 standing from the bottom thereof. The interior of the container 1 is divided by the partition wall 2 into inner and outer compartments 3 and 4. A lid 5 is attached to the top of the container 1 so as to close upper openings of the compartments 3 and 4. The lid 5 has two inlets 6 and 7 formed therein to correspond to the compartments 3 and 4 respectively. A liquid 8 is poured through the inlets 6 and 7 into the respective compartments 3 and 4. Thereafter, closures 9 and 10 are closely fitted into the inlets 6 and 7 respectively.

In the balancer described above, the liquid 8 contained in the container 1 leaks out or flows between the compartments 3 and 4 if the compartments are not watertightly sealed by the lid 5 or if the inlets 6 and 7 are not watertightly closed by the respective closures 9 and 10. Consequently, an expected correcting force cannot be obtained when the liquid 8 leaks out of the container 1 or flows between the compartments 3 and 4. In view of this problem, watertight tests need to be carried out for the balancer.

The watertight tests are carried out in the following procedure. The interior of the compartment 3 is pressurized or depressurized through the inlet 6 after the lid 5 has been attached to the container 1. Consequently, the watertightness is tested at a boundary 11 between an inner wall of the container 1 and the lid 5 and at a boundary 12 between the partition wall 2 and the lid 5. Subsequently, the interior of the compartment 4 is pressurized or depressurized through, the inlet 7 in order that the watertightness is tested at a boundary 13 between an outer wall of the container 1 and the lid 5. Finally, the inlets 6 and 7 are closed by the respective closures 9 and 10 after the liquid 8 has been poured into the compartments 3 and 4 through the inlets respectively. The completed balancer is then put into a chamber, and the interior of the chamber is pressurized or depressurized in order that the watertightness at boundaries between the circumferential edges of the inlets 6 and 7 and the closures 9 and 10 is tested.

In the conventional balancer, the watertight test needs to be carried out for each of the compartments 3 and 4, and furthermore, the other watertight test needs to be carried out at a stage of the end product of balancer. Accordingly, steps of the watertight test is increased with an increase in the number of compartments of the container. Furthermore, since the portions of the balancer to be tested are diverse, an equipment for the watertight test is rendered complicate, and accordingly, the cost of equipment is increased.

On the other hand, the number of compartments of the container or the height of the balancer is increased in the prior art so that the performance of the balancer is improved. In each case, the size of the balancer is increased, which results in an increase in the size of the washing machine or a decrease in a washing capacity of the washing machine.

Furthermore, the correcting performance of the balancer mainly depends upon the configuration of the container 1. The correcting performance of the balancer cannot be altered after its configuration has been determined.

SUMMARY OF THE INVENTION

Therefore, an object of the present invention is to provide a balancer for the dehydration tub of the washing machine or the like wherein the watertight test can readily be carried out and the correcting performance thereof can be improved without an increase in the size of the container or without any alteration in the configuration of the container.

The present invention provides a balancer mounted on an upper portion of a dehydration tub rotated for centrifugal dehydration, comprising a balancer container formed into an annular configuration and having an upper opening, at least one partition wall standing from a bottom of the container so as to divide the interior of the container into at least two concentric compartments, a predetermined amount of liquid contained in each compartment of the container, a lid mounted on an upper portion of the container so as to close upper openings of the compartments, an air passage formed in a boundary between the partition wall and the lid so as to extend along a circumference of the container, and at least one hole formed in the lid to communicate with the air passage.

According to the above-described construction, the inner compartment communicates with the outside through a gap when the gap is formed in a boundary between the lid and an inner wall of the container. The outer compartment also communicates with the outside through a gap when the gap is formed in a boundary between the lid and an outer wall of the container. Furthermore, each compartment communicates with the outside through a gap, the air passage and the hole of the lid when the gap is formed in a boundary between the lid and the partition wall. Consequently, whether each compartment is watertightly sealed by the lid can be inspected by a single test regardless of the number of compartments.

The air passage is preferably defined by a groove formed in an upper end face of the partition wall so as to extend along the circumference of the container or by a groove formed in a portion of the underside of the lid adjacent to the upper end face of the partition wall so as to extend along the circumference of the container. Furthermore, the air passage is preferably formed by both of the above-described grooves. The groove formed in the partition wall preferably has a V-shaped section. The groove formed in the lid preferably has an inverted V-shaped section.

The lid preferably has inner and outer ribs formed on the underside thereof so as to hold an upper end of the partition wall therebetween. The inner and outer ribs preferably have respective heights differing from each other.

The liquid is preferably a solution of calcium chloride. A saturated solution of calcium chloride has a larger specific gravity than a conventionally used saturated solution of sodium chloride. Consequently, the use of the solution of calcium chloride can improve the correcting force. Furthermore, the liquids contained in the respective compartments of the container preferably have specific gravities differing from each other. In this case, the performance of the balancer can be altered even after the configuration thereof has been determined.

The container is preferably molded out of a plastic. In this case, the balancer may further comprise a radial rib provided on an imaginary line between a pouring gate and a center of the annular container.

The invention further provides a balancer mounted on an upper portion of a rotatable tub of a full automatic washing machine, comprising a balancer container formed into an annular configuration and having an upper opening, at least one partition wall standing from a bottom of the container so as to divide the interior of the container into at least two concentric compartments, a predetermined amount of solution of calcium chloride contained in each compartment of the container, and a lid mounted on an upper portion of the container so as to close upper openings of the compartments.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1:
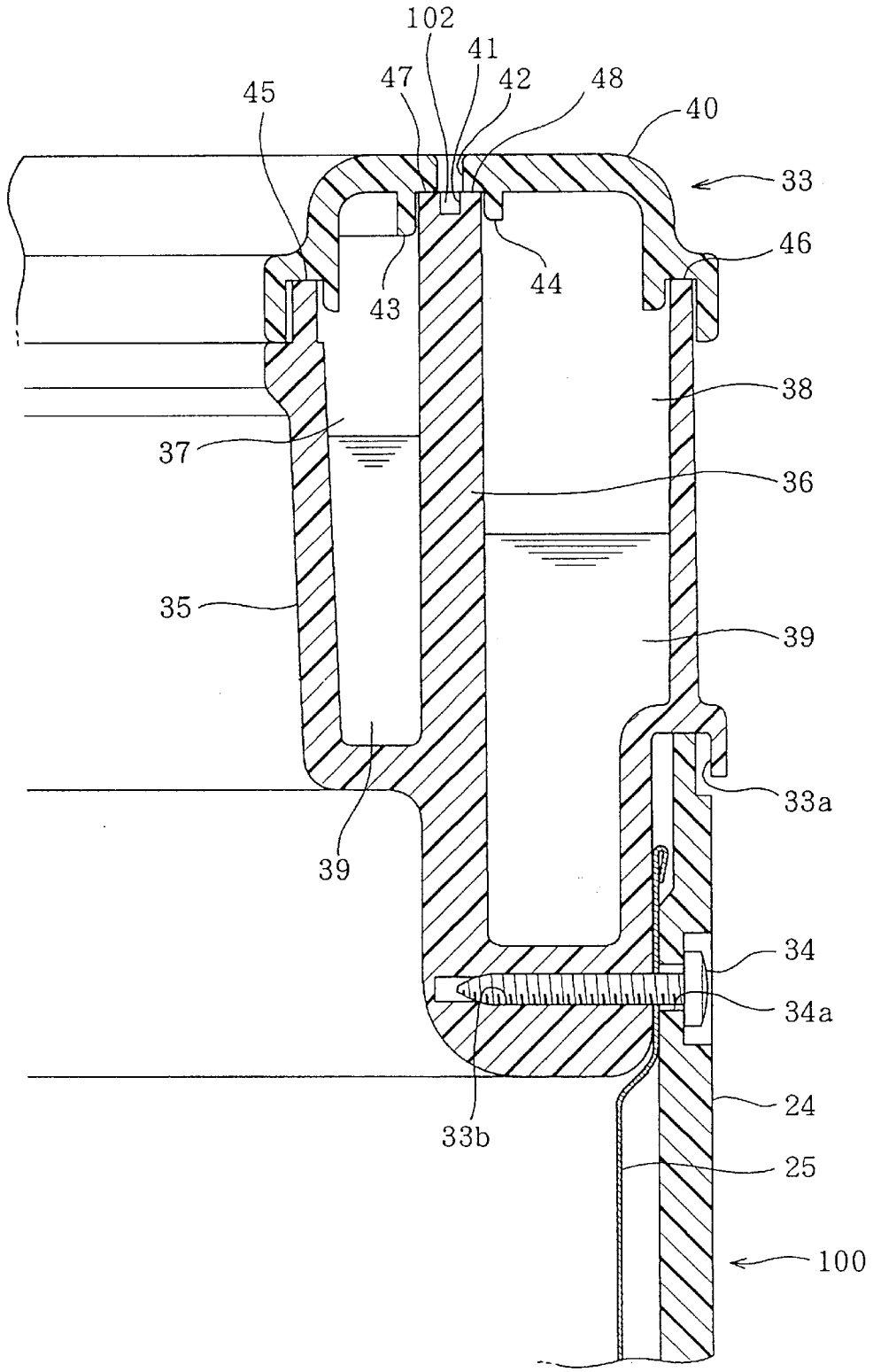
FIG. 1 is a longitudinal section taken along line 1—1 in FIG. 2, showing the balancer of a first embodiment in accordance with the present invention.
Figure 2:
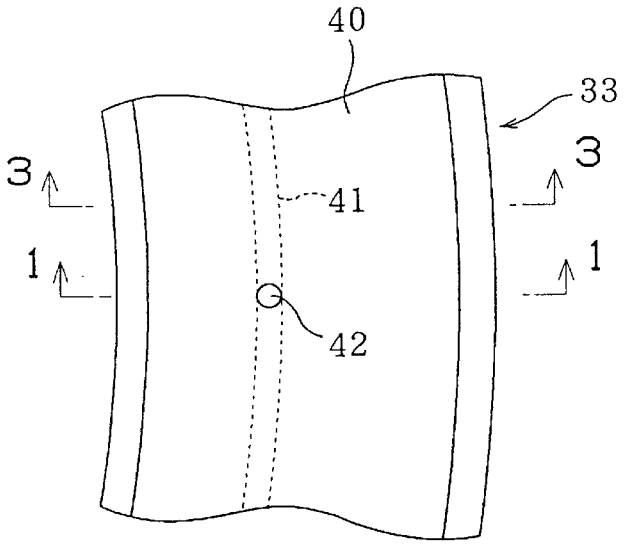
FIG. 2 is a plan view showing a part of the balancer including a hole.

A first embodiment of the present invention will be described with reference to FIGS. 1 to 5. Referring to FIG. 4, a full automatic washing machine is shown to which the balancer of the invention is applied. An outer cabinet 21 encloses an outer stationary tub 22 supported therein by a plurality of elastic suspension mechanisms 23 one of which is shown. A rotatable tub 100 serving as a wash tub and a dehydration tub is rotatably mounted in the outer tub 22. The rotatable tub 100 comprises an inner tub 24, a porous inner basket 25 provided for defining a water-passing space with an inner wall of the inner tub 24, and a balancer 33 mounted on an upper end of the inner tub 24.

Figure 3:
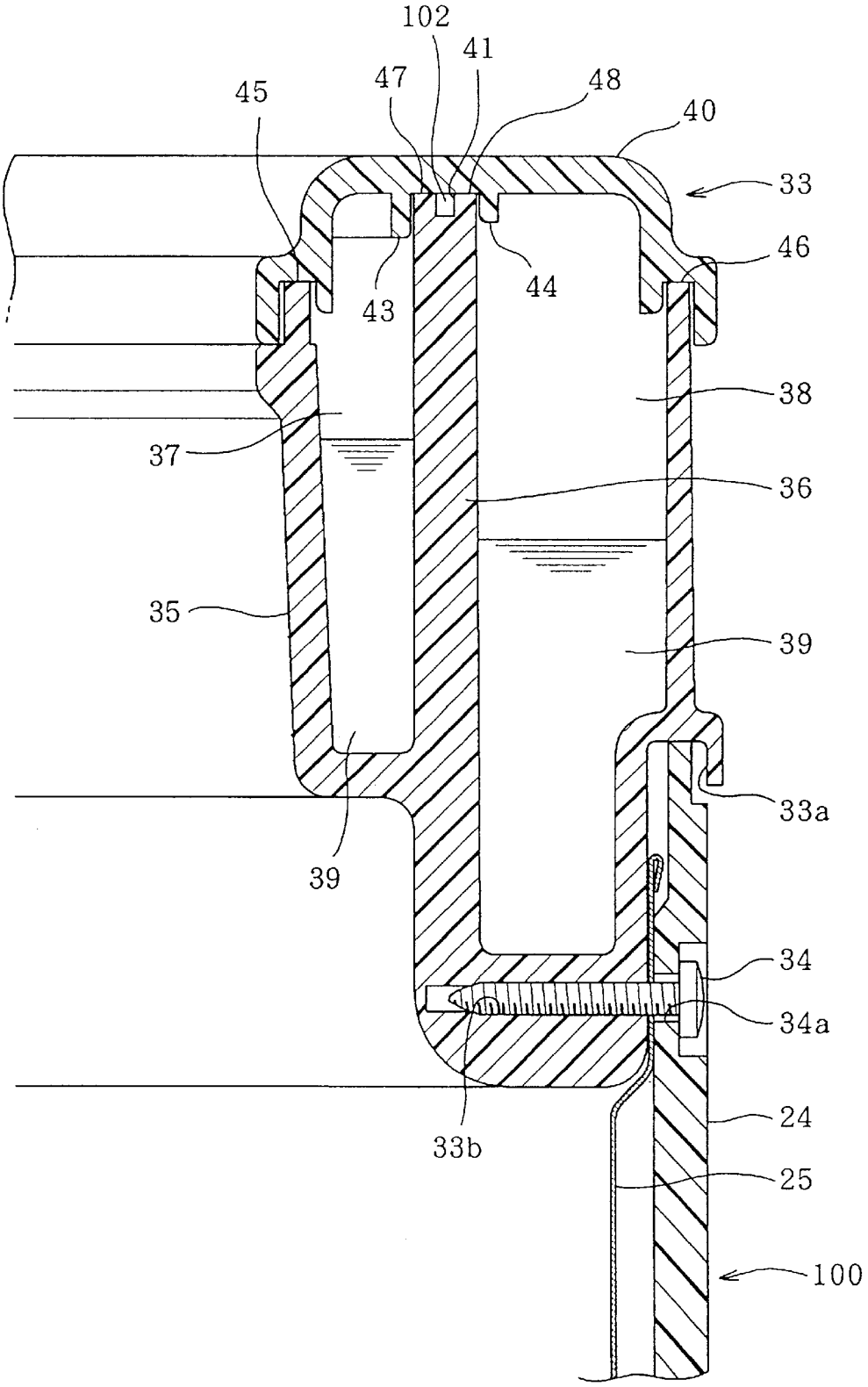
FIG. 3 is a longitudinal section taken along line 3—3 in FIG. 2.
Figure 4:
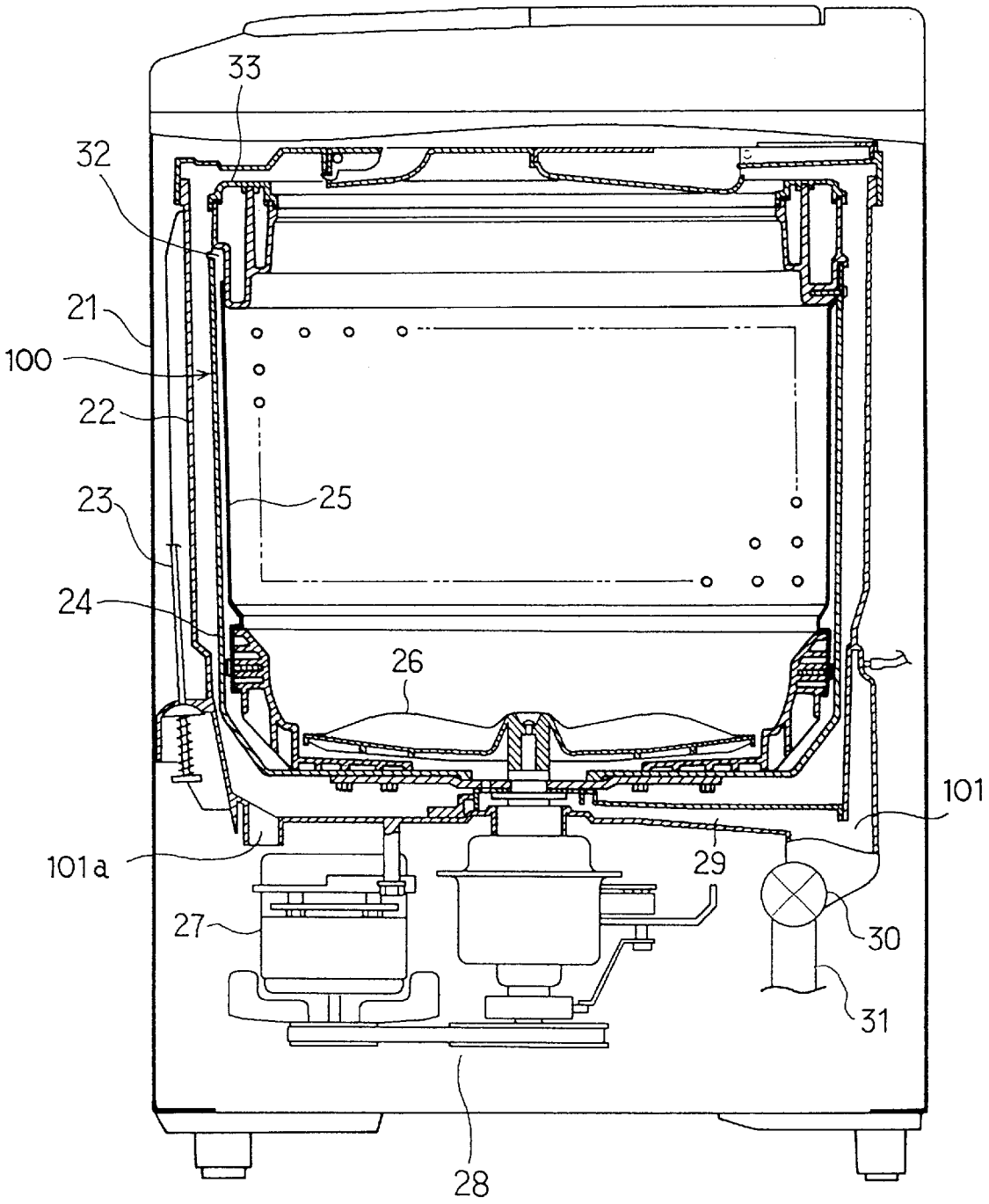
FIG. 4 is a longitudinal side section of a full automatic washing machine in which the balancer is incorporated.

Referring to FIGS. 1 and 3, the balancer 33 has an engagement recess 33*a* formed in a lower portion of its outer circumference and a screw hole 33*b* formed in the bottom thereof. The inner basket 25 has an upper portion having a diameter slightly larger than the other portion thereof such that the upper portion of the basket 25 and an upper portion of the inner tub 24 are overlapped. A through hole 34*a* is formed in the overlapped portions of the basket 25 and the inner tub 24. The engagement recess 33*a* of the balancer 33 is attached to an upper end of the inner tub 24, and a screw 34 is screwed through the hole 34*a* into the screw hole 33*b* so that the balancer 33 is fixed to an upper end of the rotatable tub 100.

Referring to FIG. 4, an agitator 26 is rotatably mounted on the bottom of the inner basket 25. A drive mechanism 28 including an electric motor 27 is provided below the outer tub 22. Both of the rotatable tub 100 and the agitator 26 are rotated by the drive mechanism 28 during a dehydration step of a washing operation, whereas only the agitator 26 is rotated by the drive mechanism 28 during a wash step.

A drainage channel 29 is formed along the right-hand bottom of the outer tub 22 as viewed in FIG. 4. The drainage channel 29 communicates with a drain hole 101. A drain valve 30 is provided in the drain hole 101, and a drain hose 31 is connected to the drain hole 101. Water in the rotatable tub 100 is discharged through the drain channel 29, the drain hole 101, and the drain hose 31 when the drain valve 30 is opened.

Figure 5:
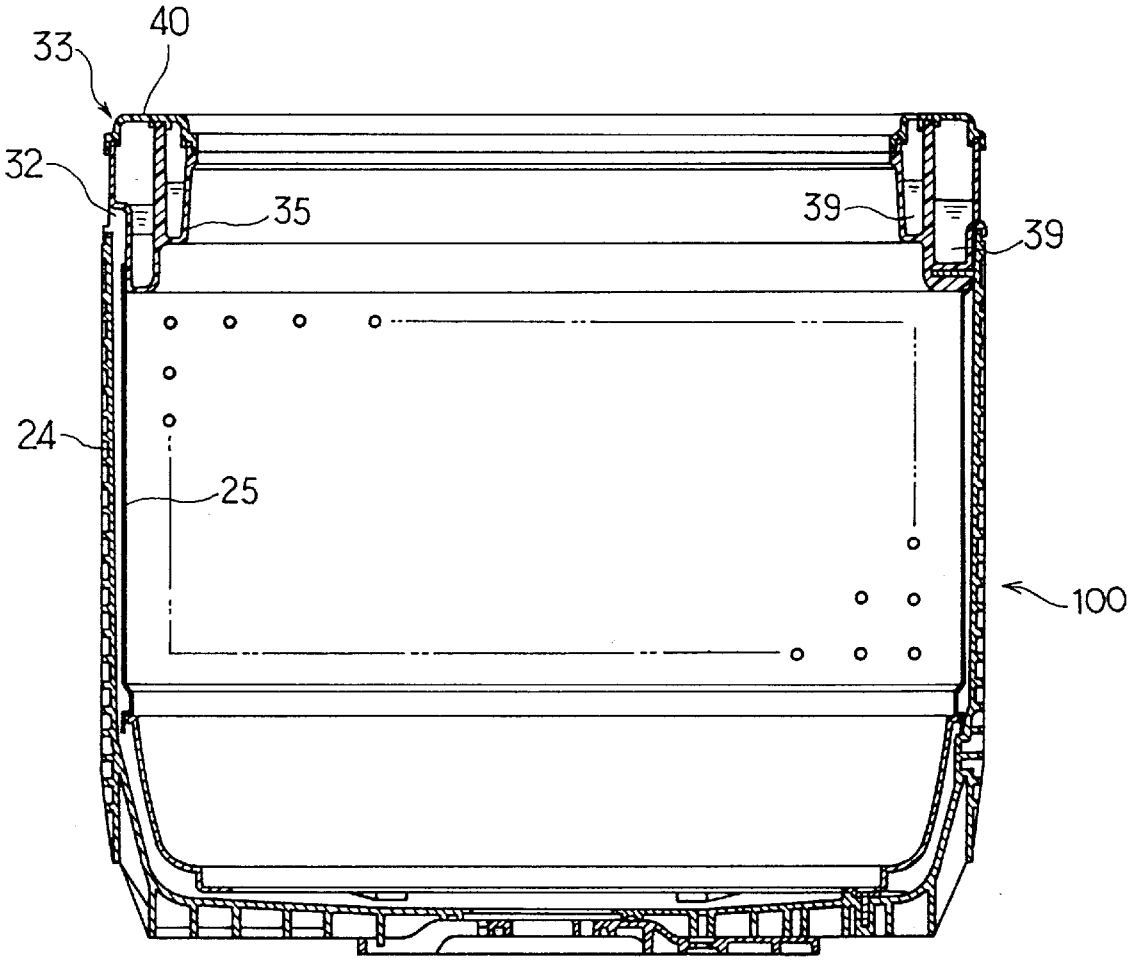
FIG. 5 is a longitudinal side section of a dehydration tub of the washing machine.

An auxiliary drain hole 101*a* is formed in the left-hand bottom of the outer tub 22 as viewed in FIG. 4. The auxiliary drain hole 101*a* communicates with the drain hose 31 through a connecting hose (not shown). The inner tub 24 has a number of dehydrating through holes 32 formed in an upper portion thereof, as shown in FIG. 5. Upon rotation of the inner tub 24 in the dehydration step, water in the inner tub 24 is caused to rise along the inner circumferential face of the inner tub 24 to be discharged through the dehydrating holes 32 into the outer tub 22. The water is further discharged through the auxiliary drain hole 101*a*.

Referring to FIGS. 1 and 3, the balancer 33 will now be described. The balancer 33 comprises an annular balancer container 35 molded out of a plastic and having an upper opening, and a lid 40 mounted to an upper end of the container 35 by means of a rolling friction welding. The bottom of the container 35 is stepped such that an outer circumferential side interior thereof is deeper than an inner circumferential side interior thereof. A partition wall 36 stands from a stepped portion of the bottom of the container 35 to extend along the circumference of the container 35, so that the interior of the container 35 is divided by the partition wall 36 into two concentric compartments 37 and 38. About 1,000 cc of a liquid such as salt water 39 is contained in the compartment 37 and about 2,000 cc of salt water 39 is contained in the compartment 38. The salt water 39 contained in each compartment has a specific gravity of 1.16 (the specific gravity of salt water at 20° C. on the basis of water at 4° C.).

The partition wall 36 has a circumferentially extending annular groove 41 formed in a central upper end thereof. An air passage 102 is defined by the groove 41 and the underside of the lid 40. One or a plurality of through holes 42 (six, in the embodiment) are formed in a generally central portion of the lid 40 where the lid is adjacent to the partition wall 36. Each hole 42 has a diameter approximately equal to the width of the groove 41 and communicates with the groove 41.

The lid 40 has an inner rib 43 and an outer rib 44 formed on the underside thereof so as to hold the upper end of the partition wall 36 therebetween. The inner rib 43 is formed to be longer than the outer rib 44.

According to the above-described embodiment, the lid 40 is mounted to the upper end of the container 35 by the rolling friction welding after the salt water 39 is contained in each of the compartments 37 and 38 of the container 35, whereby the balancer 33 is completed. The balancer 33 is then put into a vacuum apparatus and then, the interior of the vacuum apparatus is evacuated or depressurized. In this case, when the watertight sealing is incomplete between the lid 40 and the container 35, air in the balancer 33 leaks out as follows. That is, air in the compartment 37 leaks out through a gap when the gap is formed in a boundary 45 between the lid 40 and an inner wall of the container 35. Air in the compartment 38 leaks out through a gap when the gap is formed in a boundary 46 between the lid 40 and an outer wall of the container 35. Furthermore, the air in the compartment 37 enters the air passage 102 through a gap to thereby leak out through the holes 42 when the gap is formed in a boundary 47 between the lid 40 and a portion of the upper end face of the partition wall 36 inside the groove 41. Additionally, the air in the compartment 38 enters the air passage 102 through a gap to thereby leak out through the holes 42 when the gap is formed in a boundary 48 between the lid 40 and a portion of the upper end face of the partition wall 36 outside the groove 41.

Whether the watertight sealing is complete between the lid 40 and the container 35 can be tested by checking the changes in the degree of vacuum in the vacuum apparatus, as described above. In the embodiment, the air passage 102 is defined between the partition wall 36 and the lid 40, and the lid 40 is formed with the holes 42 each communicating with the air passage 102. Consequently, whether the watertight sealing is complete between the lid 40 and each of the compartments 37 and 38 can be inspected by a single test regardless of the number of compartments of the container 35.

Furthermore, the partition wall 36 is thickened so that the groove 41 is formed therein, as compared with the partition wall of the conventional balancer container. The thicknesses of the partition wall 36 inside and outside the groove 41 respectively are approximately equal to the entire thickness of the partition wall of the conventional balancer container. Consequently, an area of the portion of the partition wall 2 welded to the lid 40 is increased, which can improve the strength of the welding.

Furthermore, the lid 40 is formed with the inner and outer ribs 43 and 44 positioned at both sides of the groove 41 to hold the upper portion of the partition wall 36 therebetween. The partition wall 36 is prevented from falling down toward the compartment 37 or 38 by the rib 43 or 44. Consequently, since a more reliable sealing is provided, the watertightness of the balancer can be improved.

The inner rib 43 is longer than the outer rib 44 in the foregoing embodiment. As a result, the container 35 and the lid 40 can readily be aligned when the lid is mounted to the upper portion of the container. Alternatively, the outer rib 44 may be longer than the inner rib 43. In this case, too, the same effect can be achieved as in the foregoing embodiment.

Although the air passage 102 is constituted by a single annular groove 41 in the foregoing embodiment, the air passage may include a plurality of arcuate grooves arranged annularly in the upper portion of the partition wall 36, instead. In this case, each arcuate groove is preferably formed to be in close vicinity of the adjacent ones, and the lid preferably has a plurality of holes formed therein to correspond to the arcuate grooves respectively. This construction can achieve the same effect as by the foregoing embodiment.

Figure 6:
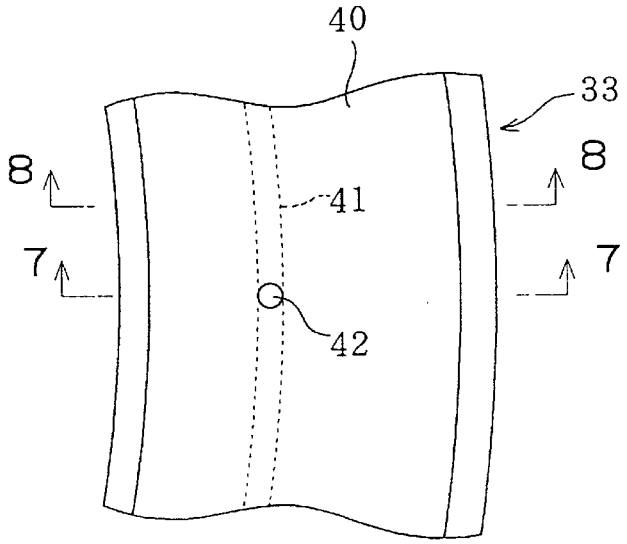
FIG. 6 is a view similar to FIG. 2, showing the balancer of a second embodiment in accordance with the present invention.
Figure 7:
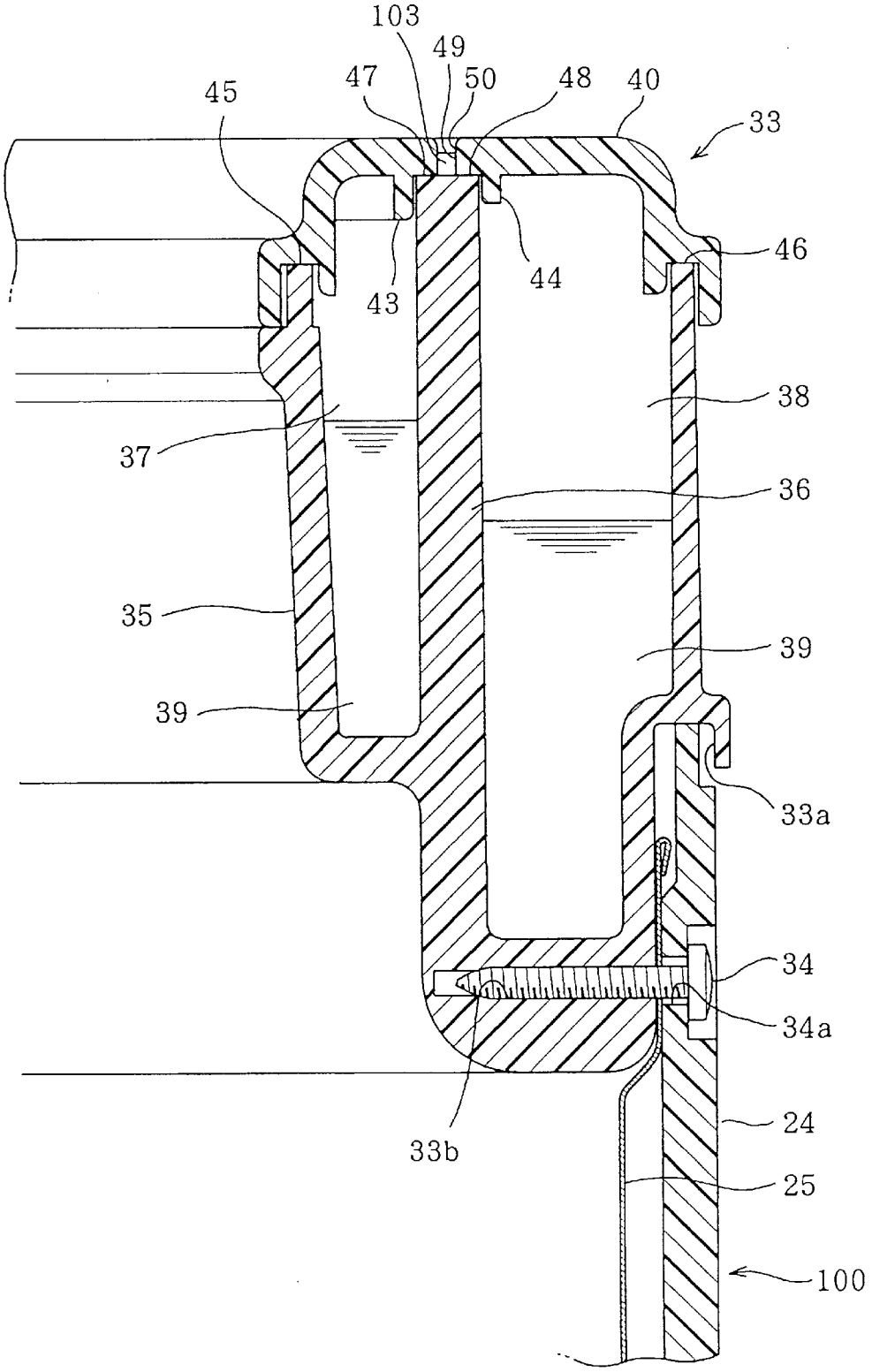
FIG. 7 is a longitudinal section taken along line 7—7 in FIG. 6.
Figure 8:
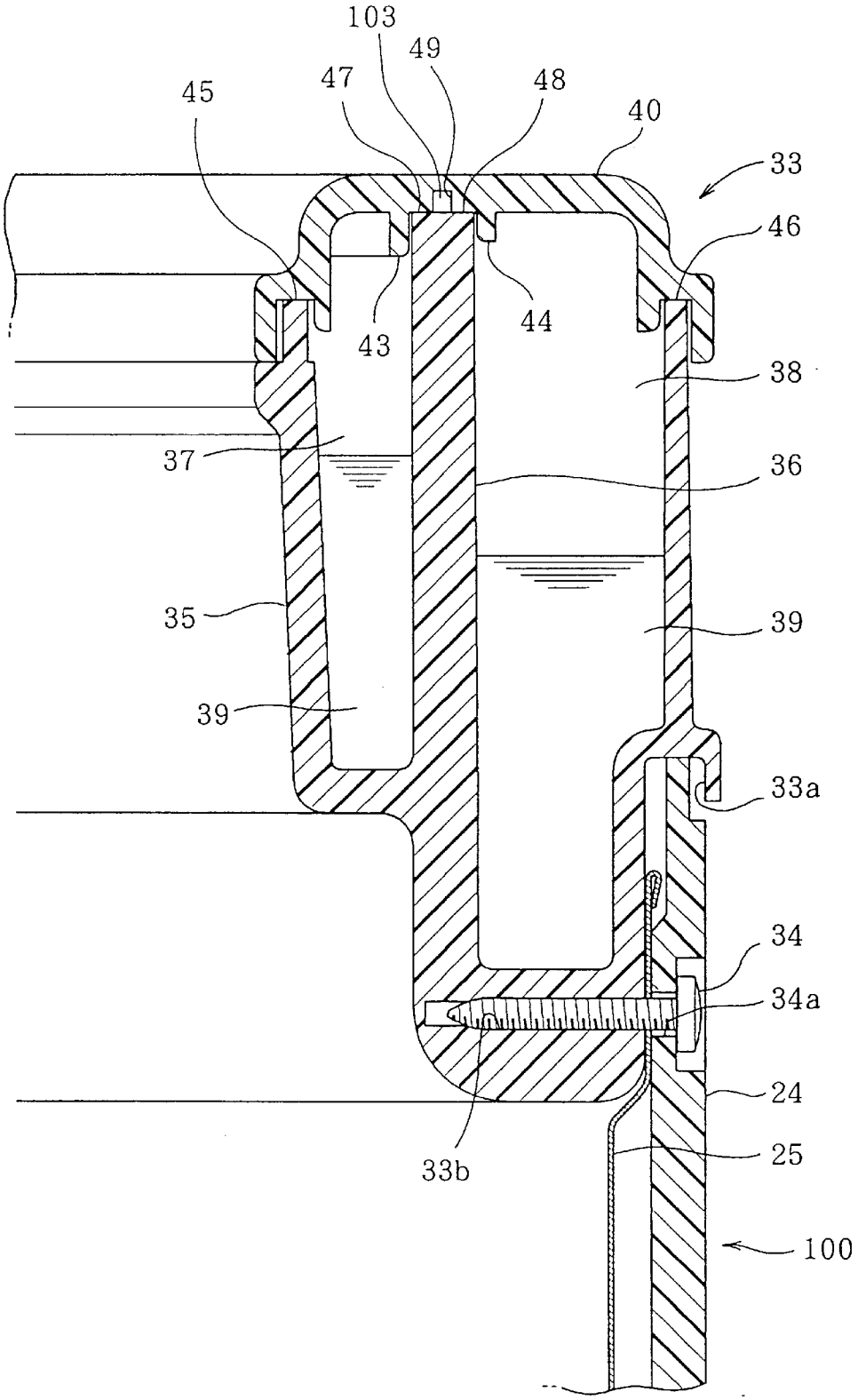
FIG. 8 is a longitudinal section taken along line 8—8 in FIG. 6.

FIGS. 6 to 8 illustrate a second embodiment of the invention. Differences between the first and second embodiments will be described. Identical parts are labeled by the same reference symbols as in the first embodiment. In the second embodiment, a circumferentially extending groove 49 is formed in a portion of the underside of the lid 40 abutted against the upper end face of the partition wall 36, instead of the groove 41 in the first embodiment. The air passage 103 is defined by the groove 49 and the upper end face of the partition wall 36. Furthermore, through holes 50 are formed to extend from the groove 49 to the upper end face of the lid 40, instead of the holes 42 in the first embodiment. The other construction of the balancer in the second embodiment is the same as that in the first embodiment. Since the holes 50 communicate with the air passage 103, the same effect can be achieved in the second embodiment as in the first embodiment.

Figure 9:
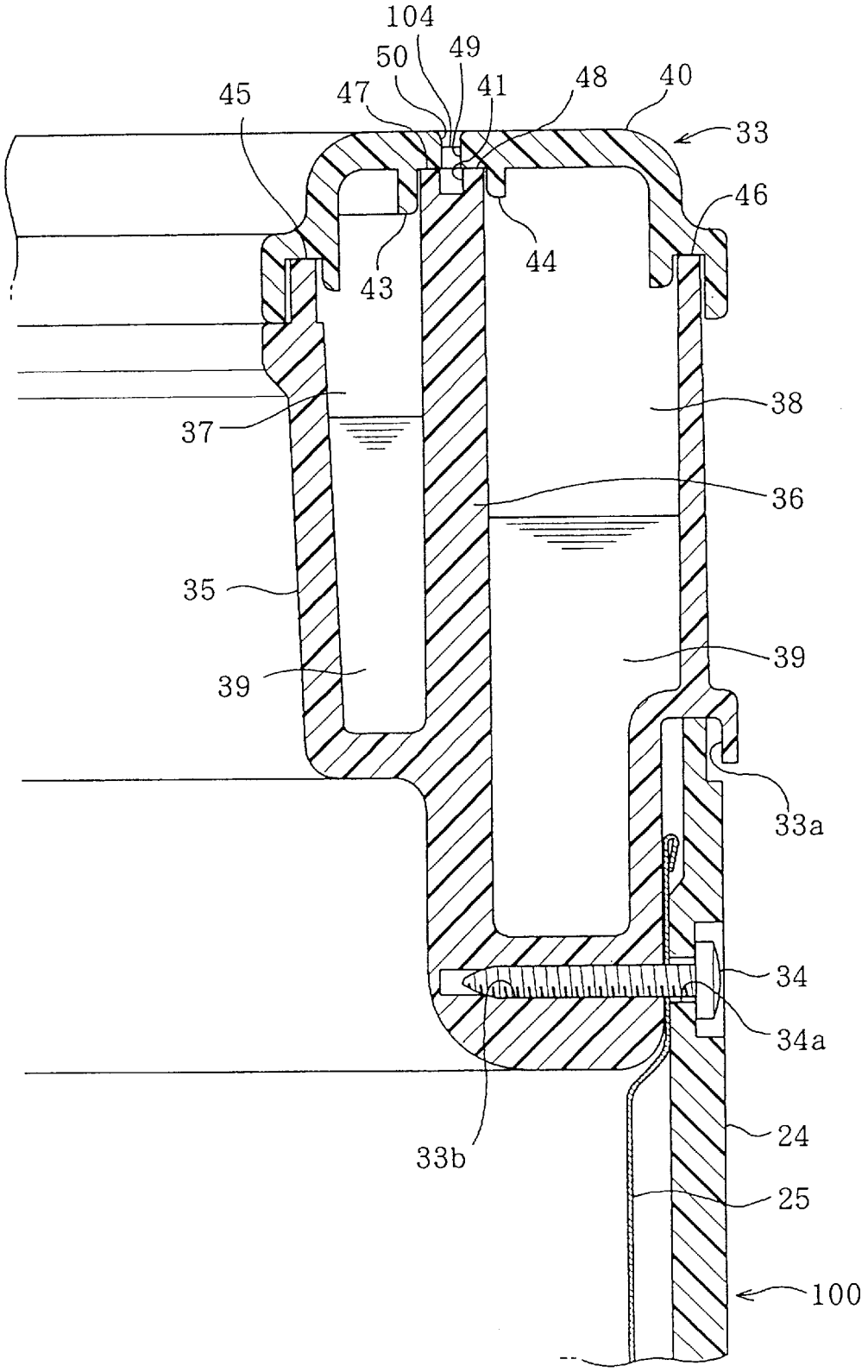
FIG. 9 is a view similar to FIG. 1, showing the balancer of a third embodiment in accordance with the present invention.
Figure 10:
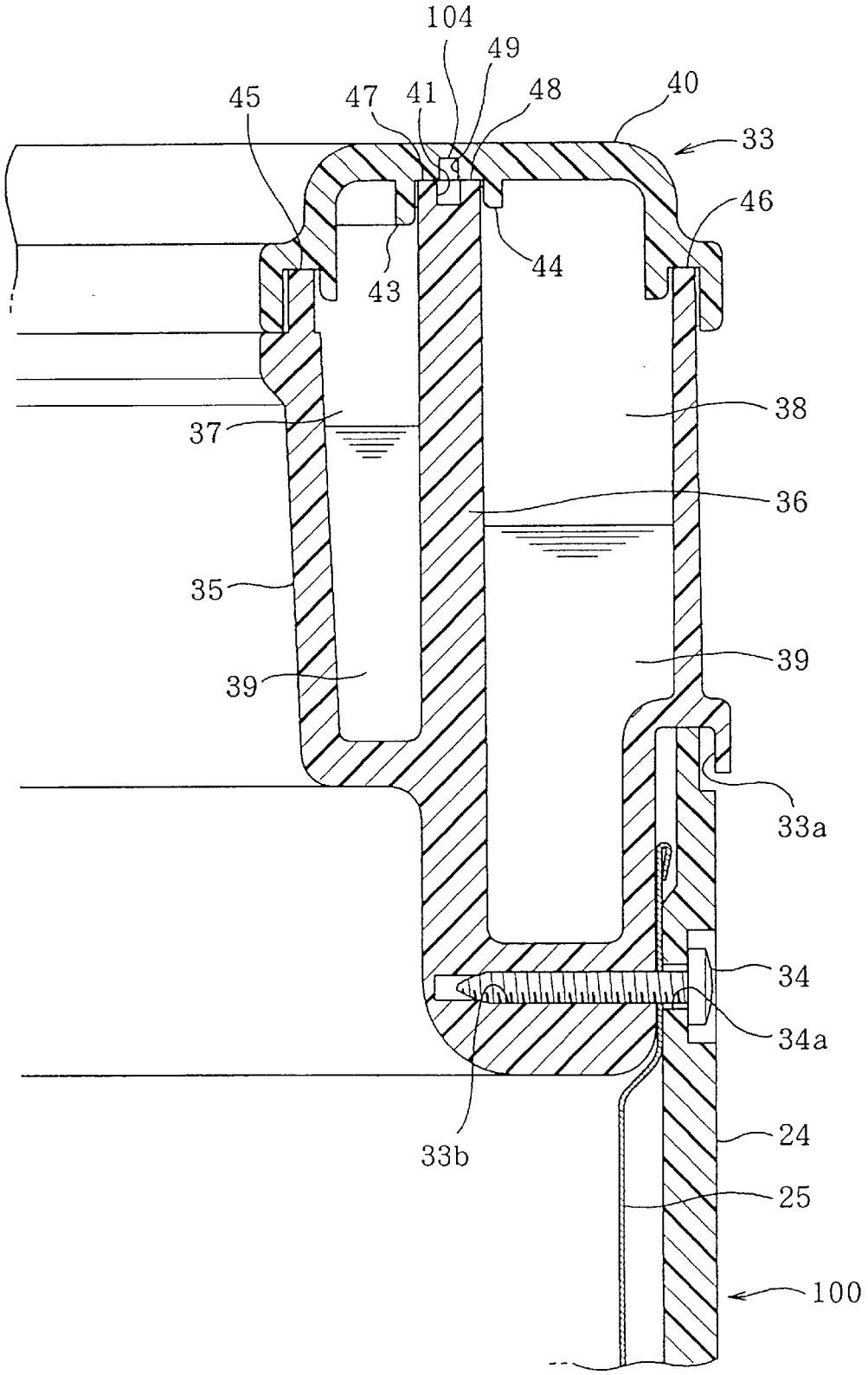
FIG. 10 is a view similar to FIG. 3, showing the third embodiment.
Figure 11:
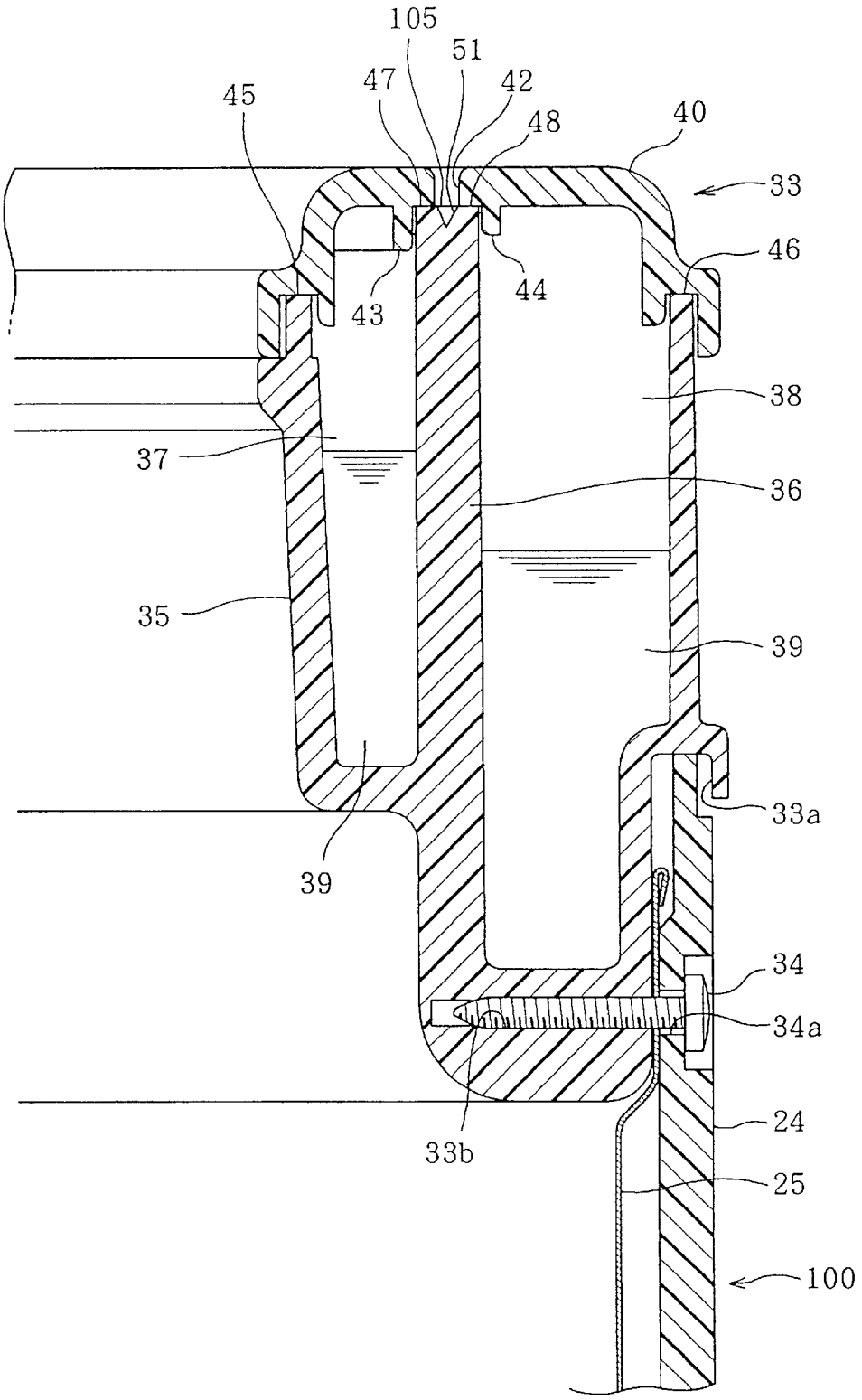
FIG. 11 is a view similar to FIG. 1, showing the balancer of a fourth embodiment in accordance with the present invention.
Figure 12:
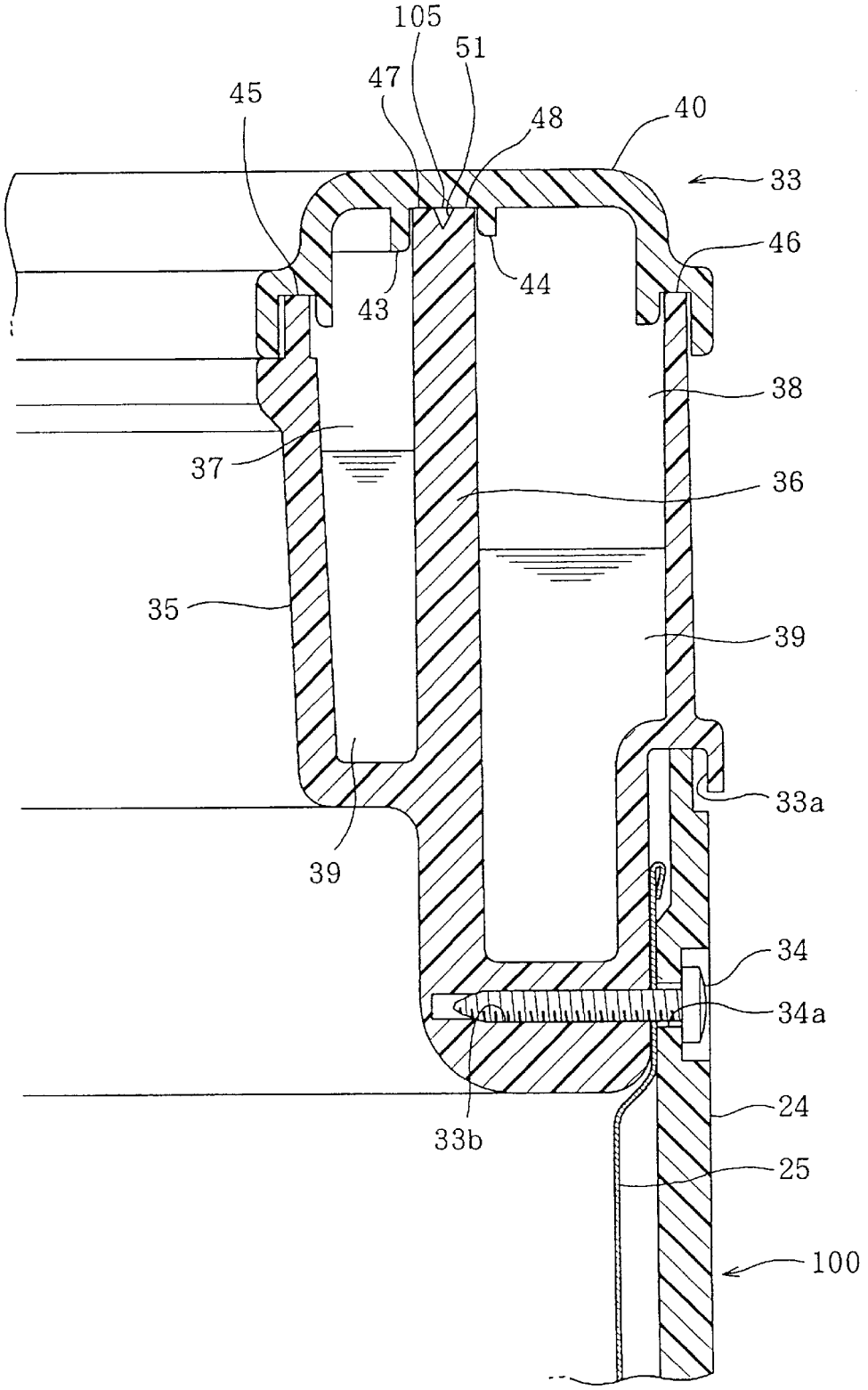
FIG. 12 is a view similar to FIG. 3, showing the fourth embodiment.

FIGS. 9 and 10 illustrate a third embodiment of the invention. The construction of the balancer in the third embodiment is a combined construction of those of the first and second embodiments. More specifically, the partition wall 36 has the groove 41 formed in the upper end face thereof as described in the first embodiment, and the lid 40 has the groove 49 formed in the underside thereof. These grooves 41 and 49 consist the air passage 104. The lid 50 also has the holes 50 formed to extend from the groove 49 to the upper end face of the lid 40. The other construction of the balancer of the third embodiment is the same as that in each of the first and second embodiments. Accordingly, the same effect can be achieved in the third embodiment as that in each of the first and second embodiments.

FIGS. 11 to 14 illustrate a fourth embodiment of the invention. Differences between the first and fourth embodiments will be described. Identical parts are labeled by the same reference symbols as in the first embodiment. In the fourth embodiment, a groove 51 having a V-shaped section is formed in the upper end face of the partition wall 36, instead of the groove 41 in the first embodiment. Accordingly, the air passage constituted by the groove 51 and the underside of the lid 40 has a triangular section.

Figure 13:
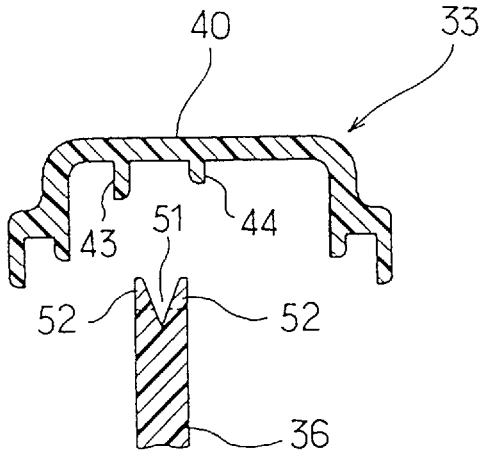
FIG. 13 is a longitudinal section of a partition wall and a lid before the welding.

The following is a detailed description of the rolling friction welding of the upper end face of the partition wall having the V-shaped groove 51 and the underside of the lid 40. FIG. 13 shows the condition of the partition wall 36 and the lid 40 before execution of the welding. Both upper side walls of the V-shaped groove 51 serve as welded portions 52. The upper end of the partition wall 36 is located between the inner and outer ribs 43 and 44 of the lid 36. Upon rotation of the lid 40, a resultant frictional heat melts the welded portions 52 such that the partition wall 36 and the lid 40 are welded together.

Figure 14:
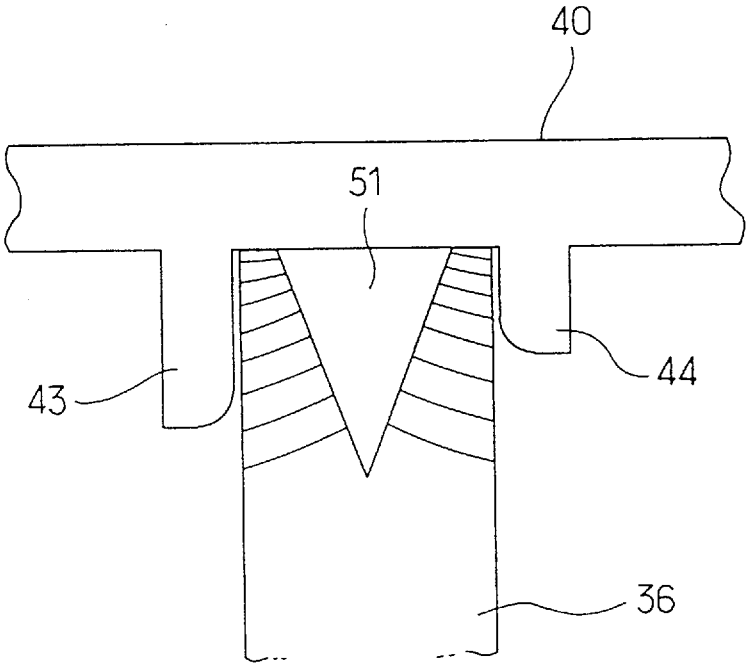
FIG. 14 is a schematic partial view of the partition wall and the lid during the welding.

Since the groove 51 is formed into the V shape, inner side faces of the welded portions 52 are inclined, whereas outer side faces of the welded portions 52 are vertical. A distance between the upper end face of the partition wall 36 and a point on the vertical outer side face of the welded portion 52 is shorter than a distance between the inner side face of the partition wall 36 and a point on the inclined inner side face of the welded portion 52 when the two points are vertically away from the upper end face of the partition wall 36 by an equal distance. Accordingly, the frictional heat transfers along the outer side face of each welded portion 52 faster than along the inner side face of each welded portion 52. FIG. 14 shows isothermal lines on the welded portions 52. The isothermal lines extending from the outer side face of each welded portion 52 are upwardly inclined toward the inner side face of each welded portion 52. In the rolling friction welding, the outer side face of each welded portion 52 reaches its melting temperature earlier than the inner side face of each welded portion 52. Consequently, since a trash resulting from the welding drops outside the groove 51, it can be prevented from being buried by the trash. A watertight test can reliably be executed regarding the groove 51.

The other construction of the balancer of the fourth embodiment is the same as that in the first embodiment. Accordingly, the same effect can be achieved in the fourth embodiment as that in the first embodiment.

Figure 15:
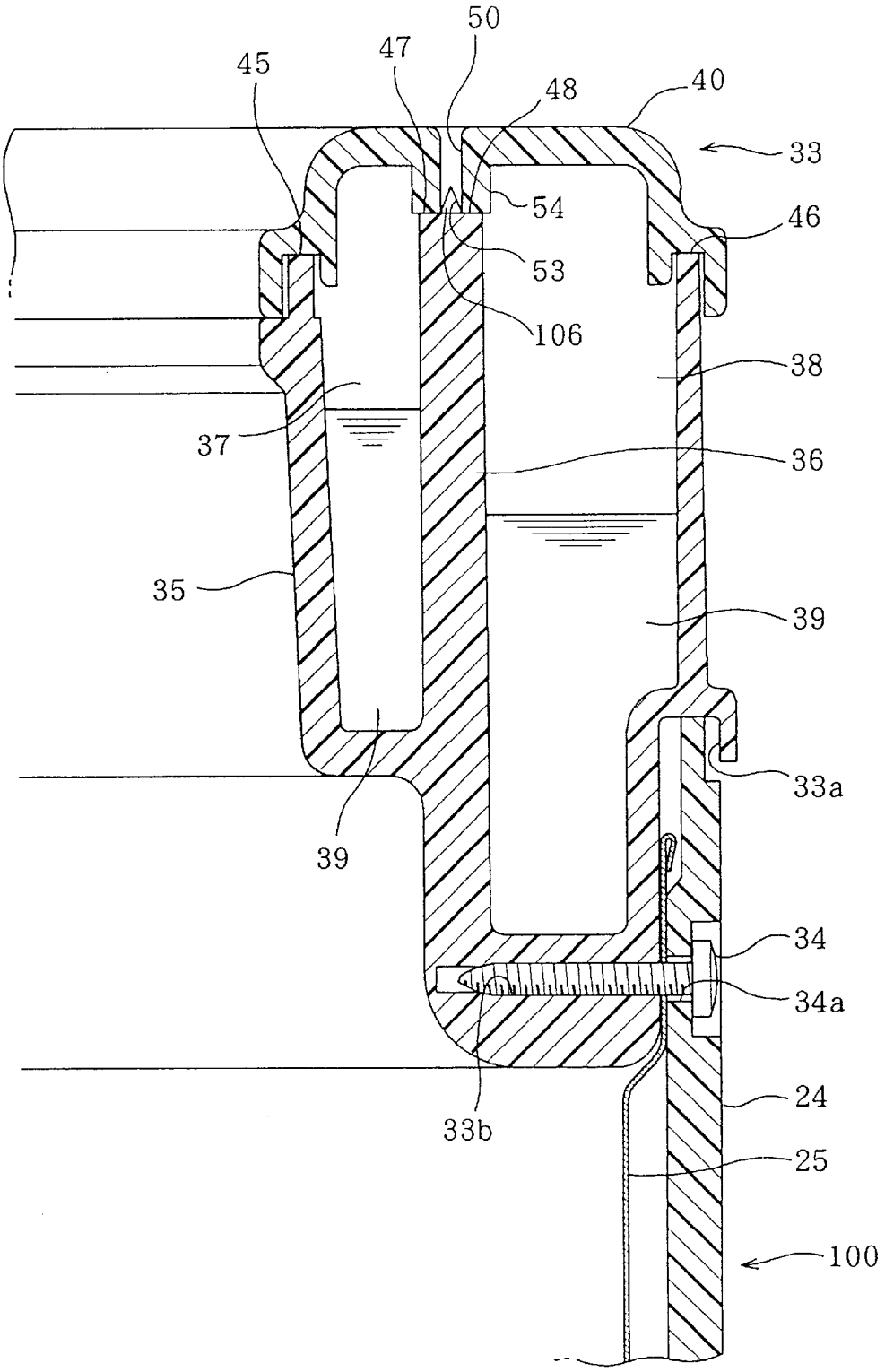
FIG. 15 is a view similar to FIG. 1, showing the balancer of a fifth embodiment in accordance with the present invention.
Figure 16:
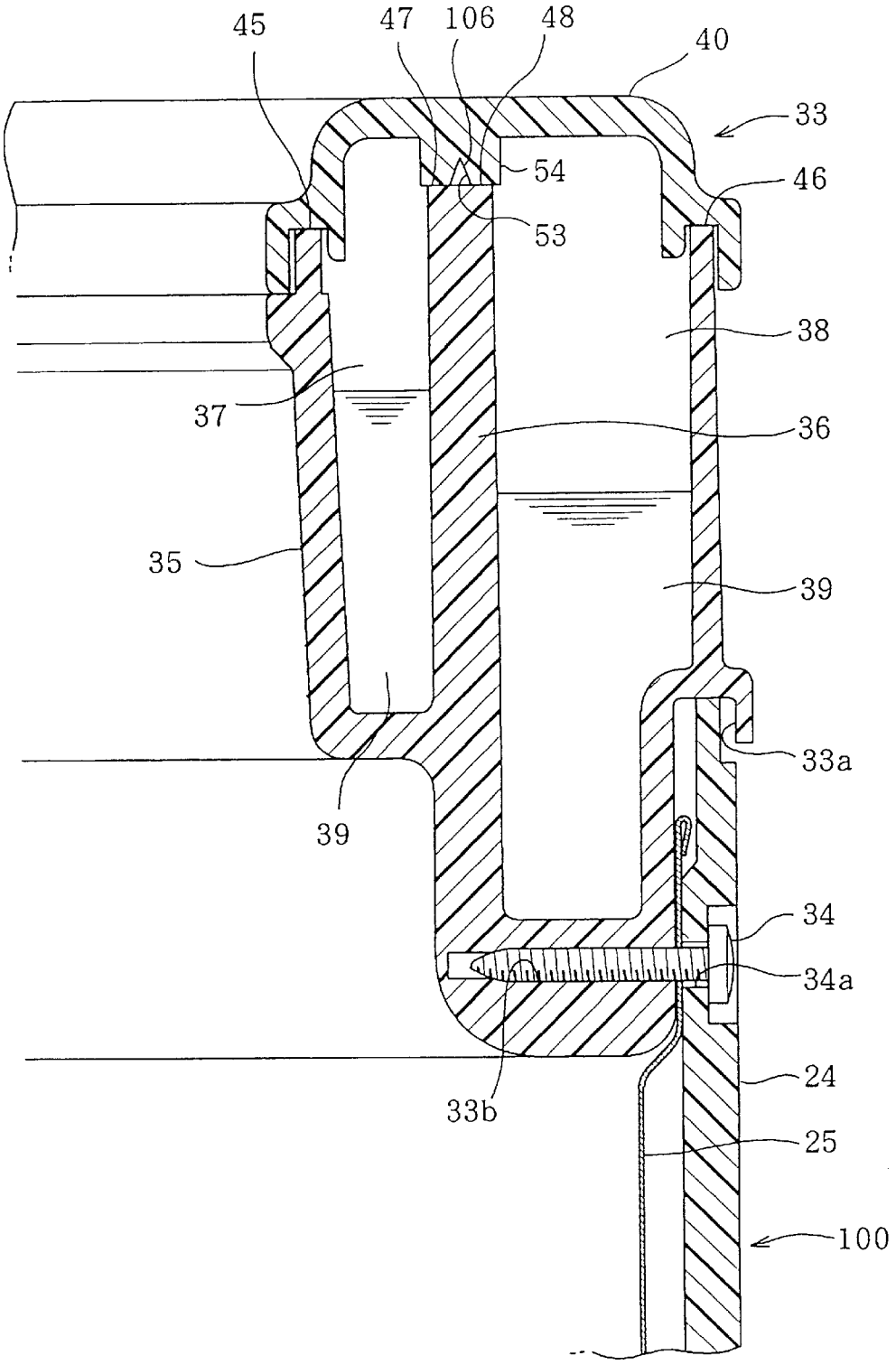
FIG. 16 is a view similar to FIG. 3, showing the fifth embodiment.

FIGS. 15 and 16 illustrate a fifth embodiment of the invention. Differences between the fourth and fifth embodiments will be described. Identical parts are labeled by the same reference symbols as in the fourth embodiment. An annular protrusion 54 is formed on the underside of the lid 36 to extend downward, thereby being abutted against the upper end of the partition wall 36. A groove 53 is formed in a lower end of the protrusion 54, instead of the groove 51 in the fifth embodiment. The groove 53 has an inverted V-shaped section. The air passage 105 is defined by the groove 53 and the upper end face of the partition wall 36. The other construction of the balancer of the fifth embodiment is the same as that in the fourth embodiment. Accordingly, the same effect can be achieved in the fifth embodiment as that in the fourth embodiment.

Figure 17:
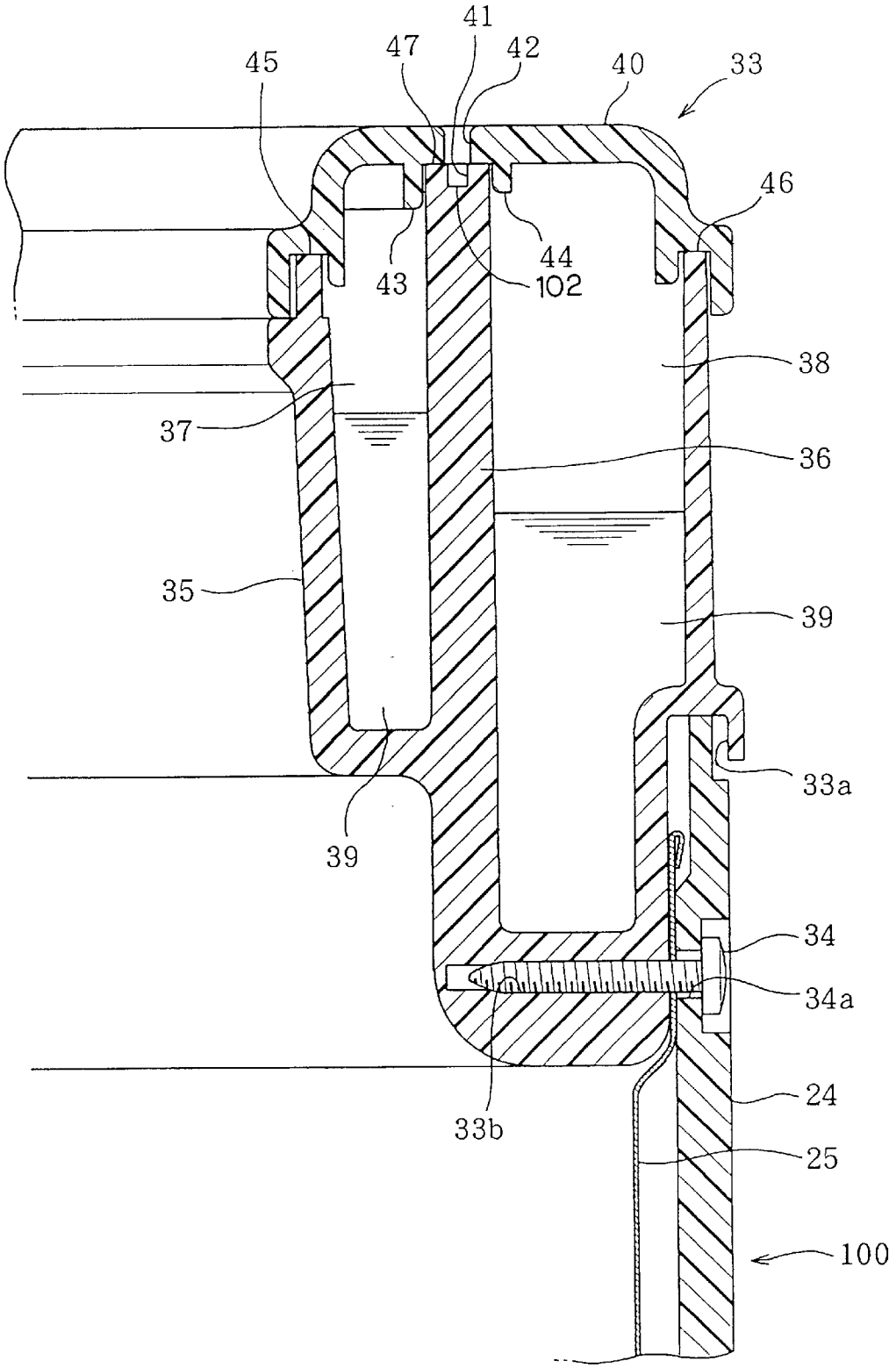
FIG. 17 is a view similar to FIG. 1 showing the balancer of a sixth embodiment.
Figure 18:
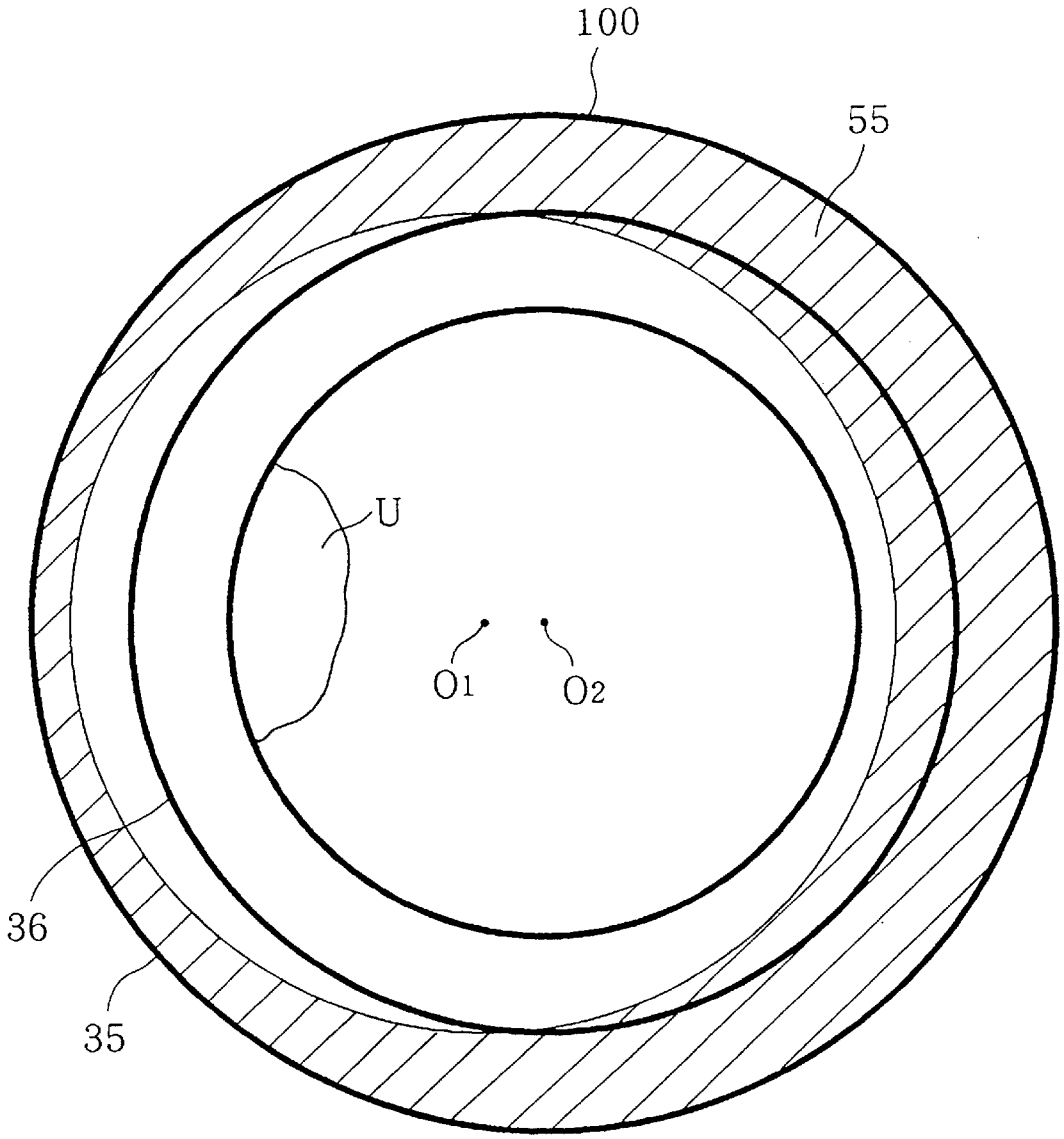
FIG. 18 is a schematic plan view of the balancer, explaining the correcting force of the balancer when the rotatable tub is in the unbalanced condition.
Figure 19:
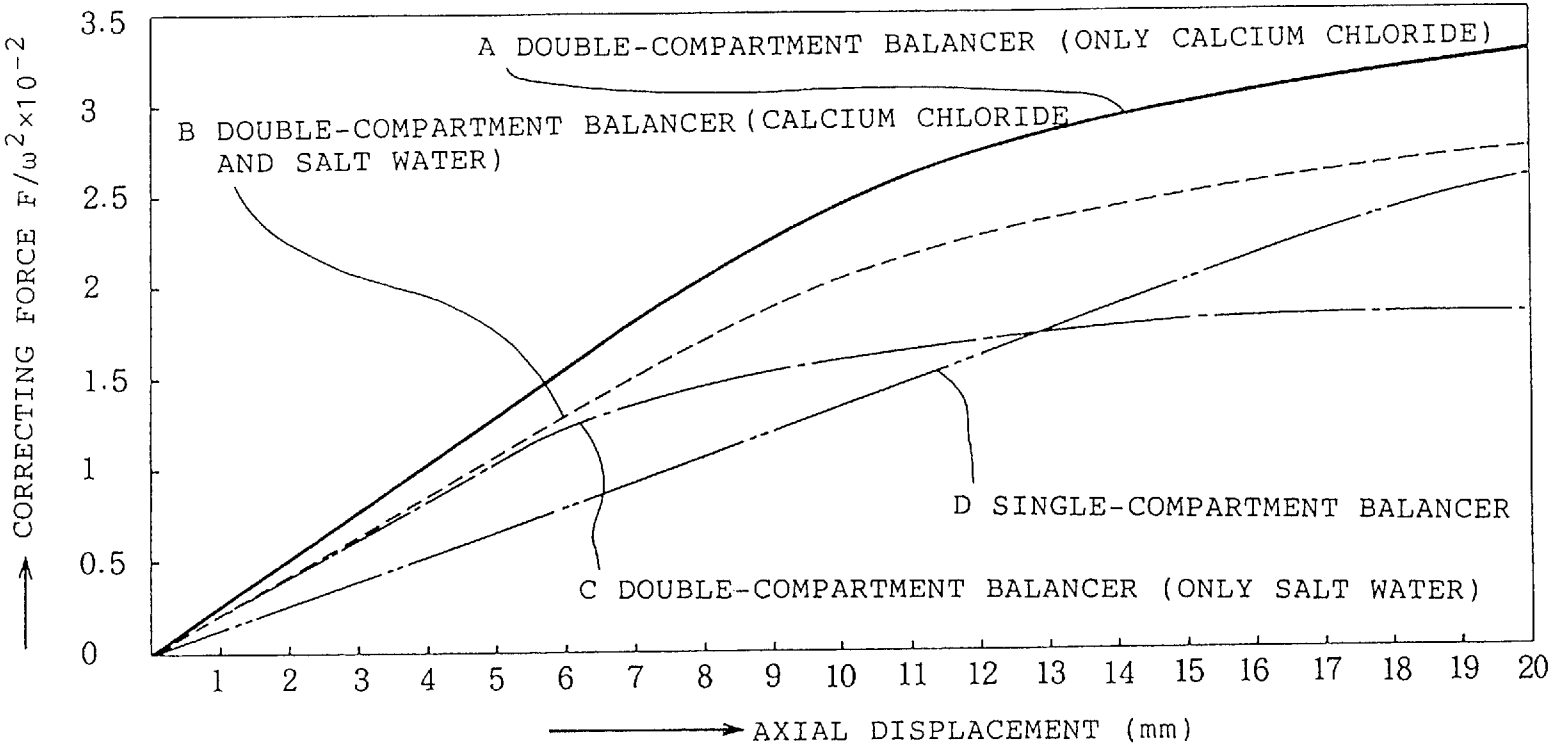
FIG. 19 is a graph showing the characteristics of the correcting forces of the balancers.

FIGS. 17 to 19 illustrate a sixth embodiment of the invention. Differences between the first and sixth embodiments will be described. Identical parts are labeled by the same reference symbols as in the first embodiment. A solution of calcium chloride 55 is contained in each of the compartments 37 and 38 of the container 35, instead of the salt water. The solution of calcium chloride 55 contained in each compartment has a specific gravity of 1.37 (the specific gravity of solution of calcium chloride at 20° C. on the basis of water at 4° C.).

Referring to FIG. 18, the case is shown where the rotatable tub 100 is in an unbalanced condition due to a partially one-sided laundry U during the dehydration step. Under this condition, the rotatable tub 100 is rotated with its central axis O1 being displaced toward the laundry U relative to a central axis O2 of the outer tub 22. The liquid or solution of calcium chloride 55 in the container 35 is distributed one-sidedly with respect to the central axis O1, as shown by oblique lines. A centrifugal force F resulting from rotation of the tub 100 acts to return the axis O1 to the axis O2. The centrifugal force F represents a correcting force of the balancer 33 and differs depending upon the configuration of the balancer and the liquid contained in the balancer container 35.

FIG. 19 shows the characteristics of the correcting forces ($F/\omega^2 \times 10^{-2}$) of various balancers with respect to displacement (mm) between the axis O1 of the rotatable tub 100 and the axis O2 of the outer tub 22. The centrifugal force F is divided by $\omega^2$ in order that influences of the rotational speed $\omega$ of the rotatable tub 100 are eliminated. The solid line A in FIG. 19 denotes the balancer 33 of the sixth embodiment. The broken line B denotes a balancer comprising a container which has the same configuration as the container of the balancer of the sixth embodiment and which includes the inner compartment containing the salt water and the outer compartment containing the solution of calcium chloride. The chain line C denotes the balancer of the first embodiment. The two dot chain line D denotes a balancer (not shown) comprising a balancer container whose interior is not divided by any partition wall and which contains 3,000 cc of salt water having a specific gravity of 1.16. FIG. 19 shows that a largest correcting force can be obtained from the balancer denoted by the solid line A irrespective of an extent of the axial displacement. One of the reasons for this is that since the specific gravity of the calcium chloride is about 1.2 times larger than that of the salt water, the centrifugal force is rendered larger in the balancer containing the solution of calcium chloride than in the balance containing the salt water.

As obvious from FIG. 19, the correcting force can be improved without an increase in the capacity of the balancer container 35 in the sixth embodiment. Consequently, the size of the washing machine can be prevented from being increased or an amount of laundry accommodated in the rotatable tub can be prevented from being decreased. The other construction of the balancer of the sixth embodiment is the same as that in the first embodiment. Accordingly, the same effect can be achieved in the sixth embodiment as that in the first embodiment.

The correcting force of the balancer denoted by the broken line B in FIG. 19 is smaller than that of the balancer denoted by the solid line A but larger than those of the balancers denoted by the chain line C and the two dot chain line D. Assume now a balancer (not shown) comprising a container which has the same configuration as the container of the balancer of the sixth embodiment and which includes the inner compartment containing a saturated solution of calcium chloride and the outer compartment containing a saturated solution of sodium chloride. It is obvious from a calculation that a correcting force of this balancer is slightly smaller than that of the balancer denoted by the broken line B but larger than those of the balancers denoted by the chain line C and the two dot chain line D. Thus, when the compartments of the container contain the solution of calcium chloride and the salt water respectively, the correcting force of the balancer is rendered intermediate between that of the balancer containing only the calcium chloride and that of the balancer containing only the salt water. Accordingly, the correcting force can be adjusted when the liquids contained in the respective compartments have different specific gravities from each other even after determination of the configuration of the balancer container. For this purpose, different kinds of solutions may be contained in the respective compartments of the container. Furthermore, the solutions contained in the respective compartments may have different densities from each other.

Figure 20:
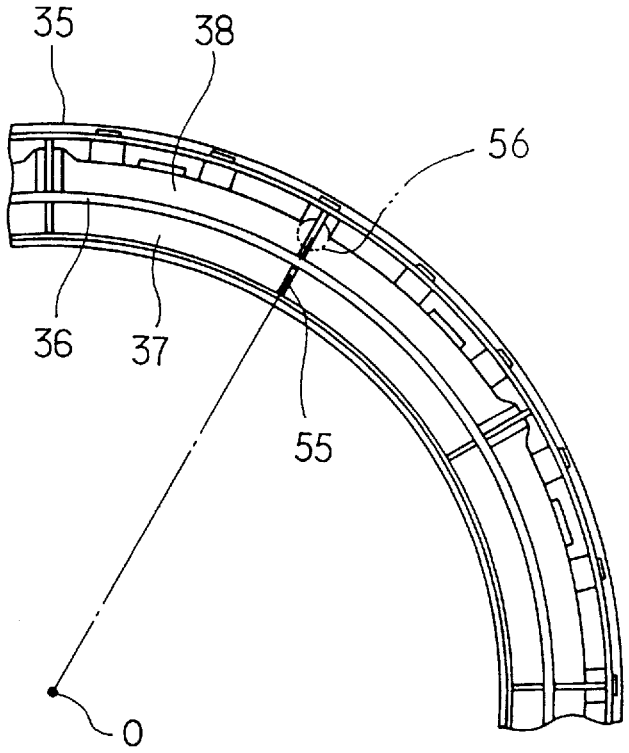
FIG. 20 is a partial plan view of a balancer container of the balancer of a seventh embodiment in accordance with the present invention.
Figure 21:
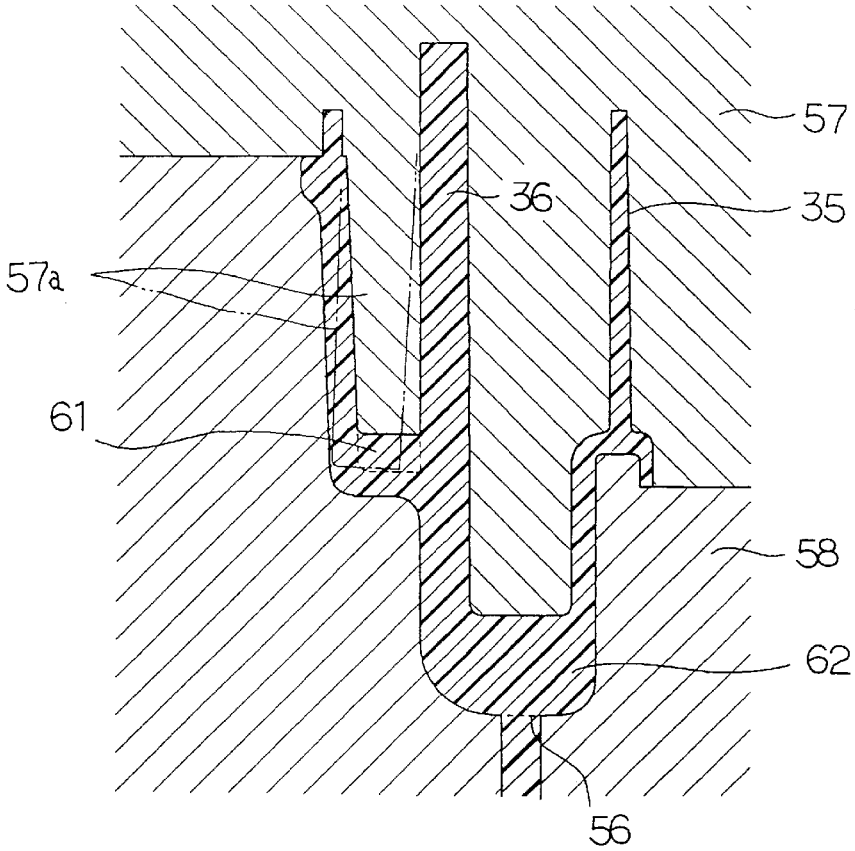
FIG. 21 is a longitudinal section of the container during the molding.

FIGS. 20 and 21 illustrate a seventh embodiment of the invention. Differences between the first and seventh embodiments will be described. Identical parts are labeled by the same reference symbols as in the first embodiment. The container 35 is molded out of molten resin poured into a die assembly including an upper die 57 and a lower die 58, as shown in FIG. 21. The container 35 has radial ribs 61 and 62 formed on the bottom thereof so as to be located on an imaginary line between a pouring gate 56 for the molten resin and a center O of the annular container 35. Pressure of the molten resin poured through the pouring gate 56 tends to incline an annular projection 57*a* of the die 57 for forming the inner compartment 37 of the container 35, as shown by the two dot chain line in FIG. 21. In the seventh embodiment, however, the molten resin poured through the gate 56 rapidly reaches an inner wall portion of the container 35 through the rib 61. Consequently, since the projection 57*a* of the die 57 is prevented from being inclined by the pressure of the molten resin, failure in the molding can be reduced.

Figure 22:
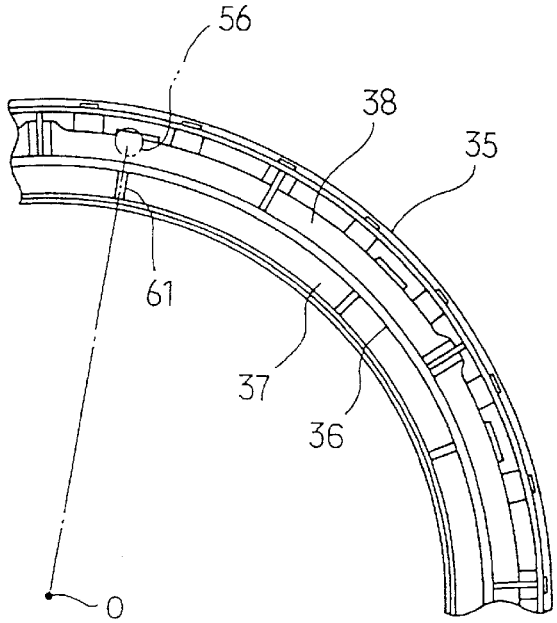
FIG. 22 is a view similar to FIG. 18, showing the balancer of an eighth embodiment in accordance with the present invention.
Figure 23:
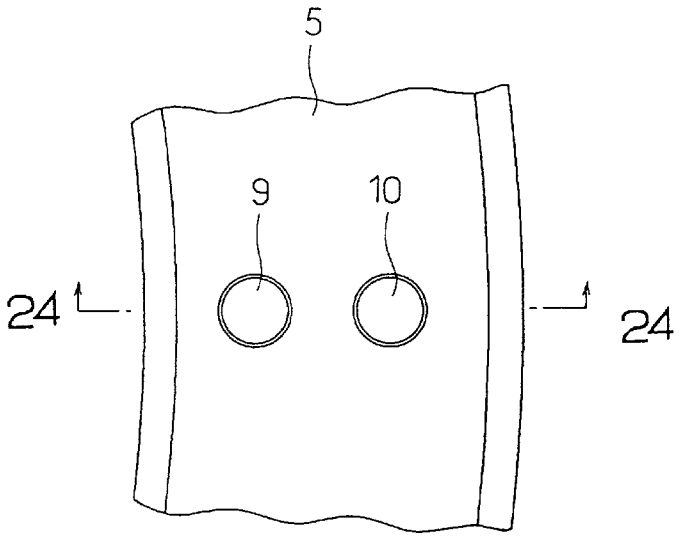
FIG. 23 PRIOR ART
FIG. 23 is a partial plan view of a conventional balancer.

FIG. 22 illustrates an eighth embodiment of the invention. The rib 62 provided over the pouring gate 56 in the seventh embodiment is eliminated in the eighth embodiment. The molten resin poured through the gate 56 strikes uniformly on the underside of the outer compartment 38 and accordingly, the die is not inclined. Consequently, the same effect can be achieved in the eighth embodiment as that in the seventh embodiment even when the rib 62 is eliminated.

Figure 24:
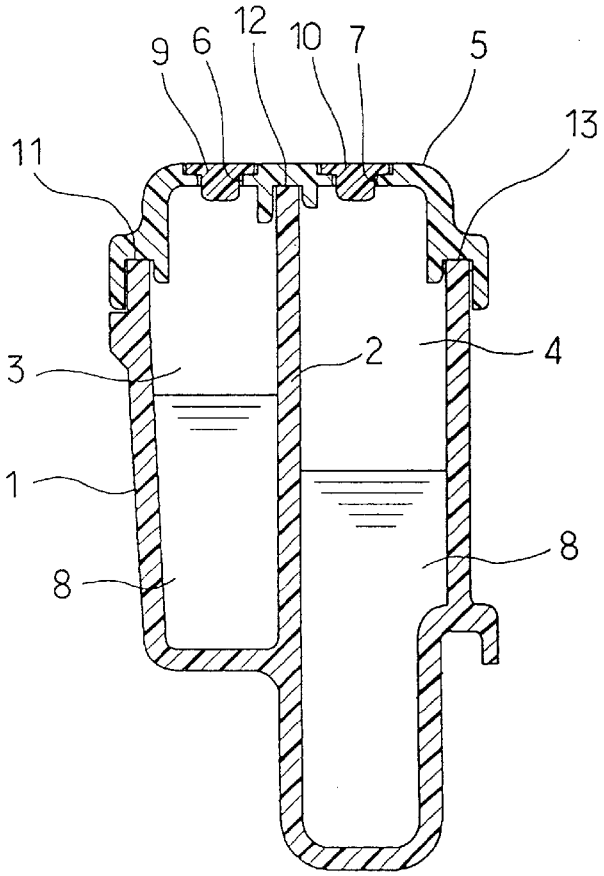
FIG. 24 PRIOR ART
FIG. 24 is a longitudinal section taken along line 24—24 in FIG. 23.

The present invention should not be limited by the embodiments described above with reference to the accompanying drawings. The number of compartments in the container may be three or more. Furthermore, the invention may be applied to the conventional balancer (FIG. 24) in which the solution of calcium chloride 55 is contained in each of the compartments 3 and 4 of the container 1. In this construction, the correcting force of the balancer can be improved although the watertight test needs to be carried out in the conventional manner. Additionally, the invention may be applied to balancers for a dehydration tub of twin tub type washing machines or independent dehydrators.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A balancer mounted on an upper portion of a dehydration tub rotated for centrifugal dehydration, comprising:

a balancer container formed into an annular configuration and having an upper opening;

at least one partition wall standing from a bottom of the container so as to divide the interior of the container into at least two concentric compartments;

a predetermined amount of liquid contained in each compartment of the container;

a lid mounted on an upper portion of the container so as to close upper openings of the compartments;

an air passage formed in a boundary between the partition wall and the lid so as to extend along a circumference of the container; and at least one hole formed in the lid to communicate with the air passage.

2. A balancer according to claim 1, wherein the air passage is defined by a groove formed in an upper end face of the partition wall so as to extend along the circumference of the container.

3. A balancer according to claim 2, wherein the groove formed in the partition wall has a V-shaped section.

4. A balancer according to claim 1, wherein the air passage is defined by a groove formed in a portion of the underside of the lid adjacent to an upper end face of the partition wall so as to extend along the circumference of the container.

5. A balancer according to claim 4, wherein the groove formed in the lid has an inverted V-shaped section.

6. A balancer according to claim 1, wherein the air passage is defined by a groove formed in an upper end face of the partition wall so as to extend along the circumference of the container and a groove formed in a portion of the underside of the lid adjacent to an upper end face of the partition wall so as to extend along the circumference of the container.

7. A balancer according to claim 6, wherein the grooves formed in the partition wall and the lid have V-shaped and inverted V-shaped sections respectively.

8. A balancer according to claim 1, wherein the lid has inner and outer ribs formed on the underside thereof so as to hold an upper end of the partition wall therebetween.

9. A balancer according to claim 8, wherein the inner and outer ribs have respective heights differing from each other.

10. A balancer according to claim 1, wherein the liquid is a solution of calcium chloride.

11. A balancer according to claim 1, wherein the liquids contained in the respective compartments of the container have specific gravities differing from each other.

12. A balancer according to claim 1, wherein the container is molded out of a plastic and which further comprises a radial rib provided on an imaginary line between a pouring gate and a center of the annular container.

* * * * *